US006107866A

United States Patent [19]

Migliavacca

[11] Patent Number: 6,107,866

[45] Date of Patent: Aug. 22, 2000

[54] BAND-GAP TYPE CONSTANT VOLTAGE GENERATING DEVICE

[75] Inventor: Paolo Migliavacca, Sassenage, France

[73] Assignee: STMicroelectrics S.A., Gentilly, France

[21] Appl. No.: 09/131,730

[22] Filed: Aug. 10, 1998

[30] Foreign Application Priority Data

Aug. 11, 1997 [FR] France ..... 97-10257

[51] Int. Cl.[7] ..... G05F 1/10

[52] U.S. Cl. ..... 327/539

[58] Field of Search ..... 323/312, 313, 323/314, 315; 327/538, 539, 540, 541, 542, 543

[56] References Cited

U.S. PATENT DOCUMENTS 4,417,164 11/1983 Edlund ..... 307/497
4,477,737 10/1984 Ulmer et al. .
4,849,684 7/1989 Sonntag et al. .
4,935,690 6/1990 Yan ..... 323/314
5,038,053 8/1991 Djenguerian et al. .
5,157,285 10/1992 Allen .
5,349,286 9/1994 Marashall et al. ..... 323/315
5,831,473 11/1998 Ishii ..... 327/530
5,900,773 5/1999 Susak ..... 327/539
5,955,874 9/1999 Zhou et al. ..... 323/615

*Primary Examiner*—Jeffrey Zweizig
*Attorney, Agent, or Firm*—Theodore E. Galanthay; Allen, Dyer, Doppelt, Milbrath & Gilchrist, P.A.

[57] ABSTRACT

A band-gap type constant voltage generating device includes a current source to generate a current increasing linearly as a function of the temperature, and a first current mirror to copy the current in the current source into an "output" leg. The output leg according to the invention comprises at least one junction with a voltage at its terminals that reduces linearly with the temperature, and a load resistance connected in series with the junction. The band-gap type constant voltage generator may be used as voltage reference.

16 Claims, 2 Drawing Sheets

BAND-GAP TYPE CONSTANT VOLTAGE GENERATING DEVICE

FIELD OF THE INVENTION

This invention relates to electronic circuits, and, more particularly, to a "band-gap" type constant voltage generating device.

BACKGROUND OF THE INVENTION

A constant voltage generating device is a generator capable of outputting a voltage that is practically unchanged despite variations in the ambient temperature. This type of generator is called "band-gap" device when it uses the property that the voltage at the terminals of one or several semiconductor junctions depends on the temperature, this voltage being a function of the width of the prohibited band (band-gap) of the semiconductor(s) considered.

A band-gap voltage reference has many applications in the microelectronics domain, and particularly for integrated electronics. For example, the band-gap voltage reference may be used as a set voltage value generator for a microprocessor power supply voltage monitoring circuit. It may also be used as a reference voltage generator for an analog-to-digital converter.

FIG. 1 shows a typical and known electrical diagram for a band-gap type constant voltage generator. The device in FIG. 1 comprises mainly a current source 10 connected in series with a resistance 12 called the adjustment resistance, and between a positive power supply terminal 14 and a ground terminal 16. An output monitoring transistor 18, electrically connected (through its gate) to a leg of a current source 10, is connected in series with a resistance 20, called the load resistance, between the power supply terminals 14, 16. The constant voltage output by the device and denoted $V_{GAP}$ is available between the ground terminal 16 and an output node 22 located between the output transistor 18 and the load resistance 20. In other words, the voltage $V_{GAP}$ is available at the terminals of the load resistance 20.

The current source comprises a first leg 10*a* with a first transistor 24*a* called the mirror transistor, in series with a second transistor 26*a* of the npn bipolar type, and a resistance 28 called the emitter resistance. The emitter resistance connects the emitter of the bipolar transistor 26*a* to a node 30. Furthermore, node 30 is connected to the ground terminal 16 through the adjustment resistance 12.

The first leg 10*a* is also called the pilot leg of the current source. A second leg 10*b* is connected in parallel to the first leg 10*a* between the positive power supply terminal 14 and the node 30. It comprises a first transistor 24*b* called the mirror and a second transistor 26*b* of the npn bipolar type, in series.

One terminal of the mirror transistor 24*b* and the collector of the bipolar transistor 26*b* in the second leg, are connected to the gate of the output follower transistor 18 at a node 32. Furthermore, the bases of the bipolar transistors 26*a* and 26*b* in the first and second legs are connected to the output node 22. According to an important characteristic of the band-gap type device shown in FIG. 1, the bipolar transistors in the two legs of the current source have different emitter surface areas. Thus, there is a difference in the base-emitter voltage for these transistors.

In the circuit shown in FIG. 1, it is considered that the bipolar transistor 26*a* in the first leg has a larger emitter surface than the emitter surface area of the bipolar transistor 26*b* in the second leg. The difference in the voltage between the base-emitter voltages $V_{BE}a$ and $V_{BE}b$ in the bipolar transistors 26*a* and 26*b* in the first and second legs respectively, is denoted $\delta V_{BE}=V_{BE}a-V_{BE}b$. This voltage difference is transferred to the terminals of the emitter resistance 28 through which a current $I_a$ passes such that:

$$I_a = \frac{\delta V_{BE}}{R_1},$$

where $R_1$ is the value of the emitter resistance 28.

As a first approximation, it is estimated that the current $I_a$ corresponding to the emitter current in the bipolar transistor 26*a* in the first leg is the same as its collector current. The current $I_a$ is thus the current in the first leg 10*a* in the current source.

The mirror transistors 24*a* and 24*b* form a current mirror used to copy the current $I_a$ passing through the first pilot leg 10*a* to the second leg 10*b*. Let the current in the second leg 10*b*, i.e. the emitter current in the bipolar transistor 26*b*, be denoted as $I_b$, and it is then found that $I_a \approx I_b$.

A current approximately equal to $I_a+I_b=2I_a$ passes through the adjustment resistance 12. Thus the voltage $V_{GAP}$ may be expressed by $V_{GAP}=V_{BE}b+2R_2I_a$, where $V_{BE}b$ is the base-emitter voltage of the bipolar transistor 26*b* in the second leg, and $R_2$ is the value of the adjustment resistance 12.

Knowing that the voltage $V_{BE}b$ reduces linearly with temperature, and that the current $I_a$ increases linearly with temperature, an appropriate choice of the value $R_2$ of the adjustment resistance 12 will hold the output voltage $V_{GAP}$ approximately constant and independent of the temperature.

For guidance, note that the expression of $\delta V_{BE}$ as a function of the temperature T is such that:

$$\delta V_{BE} = \frac{KT}{q} \ln \frac{S_a}{S_b}$$

In this formula, K is Boltzman's constant, q is the electron charge and $S_a$ and $S_b$ are the surface areas of transistor emitters 26*a* and 26*b* in the first and second legs respectively. Thus the current $I_a$ increases linearly with the temperature.

For example, the value $R_2$ of the adjustment resistance is chosen such that the voltage $V_{GAP}$ is on the order of 1.2 V when the power supply voltage between the supply terminals 14, 16 is on the order of 5 V.

When constant voltage generators as described above are made in series, and particularly in integrated manufacturing, it is found that the characteristics of the components may vary from one device to another. In particular, the bipolar npn transistors used may have different saturation currents. The spread of characteristics will affect the value of the output voltage $V_{GAP}$ obtained. Thus, it is impossible to obtain constant voltage generators with almost identical output voltages in a production run.

This phenomenon is illustrated below in an example in which it is assumed that the bipolar transistors in each of the first and second legs have saturation currents that can vary between a typical value denoted $I_{styp}$ and a maximum value $I_{smax}$. The base-emitter voltage in the bipolar transistor 26*b* in the second leg may thus vary as a function of its characteristics. The maximum variation is denoted here as $\Delta V_{BE}$ and is such that:

$$\Delta V_{BE} = \frac{KT}{q} \ln \frac{I_{styp}}{I_{smax}}$$

The value of $\Delta V_{BE}$ at ambient temperature is −7 mV for $I_{styp}=3.09\times10^{-17}$A and $I_{smax}=4.13\times10^{-17}$A. This spread of the values of $V_{BE}$ of the transistors directly influences the output voltage $V_{GAP}$ of the devices. This calculation is approximate in that it ignores transistor base currents and the Early effect of transistors. Note that the Early voltage, denoted $V_{AF}$ in the rest of this description, measures the current sensitivity of a transistor as a function of the voltage variations (transistor output impedance).

Furthermore, taking account of the base current, it is observed that the emitter current $I_E$ of bipolar transistors is different from the collector current. Denoting the collector currents in transistors 26*a* and 26*b* in the first and second legs 10*a* and 10*b* as $I_a$ and $I_b$, and their emitter currents as $I_{Ea}$ and $I_{Eb}$, the following relations can be written:

$$I_{Ea} = I_a\left(1 + \frac{V_{CEa}}{V_{AF}}\right)\left(1 + \frac{1}{\beta}\right)$$

and $$I_{Eb} = I_b\left(1 + \frac{V_{CEb}}{V_{AF}}\right)\left(1 + \frac{1}{\beta}\right)$$

the terms $V_{CEa}$ and $V_{CEb}$ referring to the collector-emitter voltages of the bipolar transistors in the first and second legs respectively, while β is the gain of these transistors.

Considering that typical values of $V_{AF}$ and β are $V_{AFtyp}$=106 and $\beta_{typ}$=142 for the bipolar transistors used, and considering that the maximum values are $V_{AFmax}$=77.8 and $\beta_{max}$=185, and considering that $V_{CEa}$=2.7 V, $V_{CEb}$=1.4 V for a power supply voltage of 5 V, correction factors $X_a$ and $X_b$ for $I_{Ea}$ and $I_{Eb}$ are obtained such that $X_a$=0.9928 and $X_b$=0.9969.

These correction factors are defined by:

$$X_a = \frac{(I_{Ea}/I_a)_{typ}}{(I_{Ea}/I_a)_{\max}} \quad \text{and} \quad X_b = \frac{(I_{Eb}/I_b)_{typ}}{(I_{Eb}/I_b)_{\max}}$$

In these formulas, the typ and max indices denote the typical and maximum values respectively.

Denoting the voltage measured at the terminals of the adjustment resistance 12 as $V_{R2}$, and the voltage difference measured at the terminals of the adjustment resistance 12 as $\Delta V_{R2}$, and using typical values and maximum values of the transistor parameters, the following values are obtained:

$$V_{R2}=(I_{Ea}+I_{Eb})\text{x}R_2$$

$$\begin{aligned}\Delta V_{R2} &= (\Delta I_{Ea} + \Delta I_{Eb})R_2 \\ &= [I_{Ea}(1 - X_a) + I_{Eb}(1 - X_b)\times R_2 \\ &\equiv I_{Ea}(2 - X_a - X_b)R_2 \\ &= 2IEaR_2 \times\left(1 - \frac{X_a + X_b}{2}\right)\end{aligned}$$

namely:

$$\Delta V_{R2} = V_{R2}\left(1 - \frac{X_a + X_b}{2}\right)$$

In this expression, when a value of 600 mV (the case for typical values) is used for $V_{R2}$, the voltage at the terminals of the adjustment resistance, we obtain $\Delta V_{R2}\approx$+3 mV. The voltage difference $\Delta V_{R2}$ at the terminals of the adjustment resistance 12, partly compensates for the voltage difference $\Delta V_{BE}$ appearing at the bipolar transistor 26*b* on the second leg.

Thus, considering the basic current and the Early effect of bipolar transistors, the spread of transistor characteristics leads to a variation in the output voltage $\Delta V_{GAP}$ such that $\Delta V_{GAP}=\Delta V_{BE}+\Delta V_{R2}$=−7+3=−4 mV. Note that the output voltage generally produced by a constant voltage generating device such as that described above is on the order of 1.2 V. In many applications this voltage is used as a reference voltage and a dispersion or spread of 4 mV would be unacceptable.

SUMMARY OF THE INVENTION

An object of this invention is to provide a constant voltage generating device which is practically insensitive to temperature, but which is also insensitive to a spread of the characteristics of its components.

More precisely, one object is to provide a voltage generator in which the output voltage is practically invariable as a function of a change in the characteristics of the bipolar transistors used.

Another object is to provide such a device with a low number of components and capable of being made at low cost.

Yet another object is to provide such a device that can be made in integrated form on a substrate, for example, such as a silicon substrate.

These and other objects in accordance with the invention are provided by a band-gap type constant voltage generating device comprising a current source with two legs to generate a current that increases linearly as a function of the temperature, and a first current mirror to copy the current in the current source into an "output" leg. The output leg according to the invention comprises at least one junction with a voltage at its terminals that reduces linearly with temperature, and a load resistance connected in series with the junction between the power supply terminals.

With this device, the variation in the output voltage as a function of the spread in the characteristics of components is particularly low. Furthermore, it also produces good insensitivity to temperature.

According to one particular aspect of the invention a first leg of the current source comprises a first transistor called the "mirror", a second bipolar transistor and an electrical resistance connecting the second bipolar transistor to a power supply terminal, in order and in series between the power supply terminals. The device also includes a second leg in the source comprising a first transistor called the mirror and a second bipolar transistor connected directly to the power supply terminal, in order and in series between the power supply terminals. The first transistors in the first and second legs form a second current mirror, and the second bipolar transistor in the first leg has an emitter surface area larger than the emitter surface area in the second transistor in the second leg.

In this specific embodiment, the first leg in the current source forms a pilot leg. The current circulating in this leg is copied by the first current mirror to the output leg. The second current mirror copies the current in the pilot leg to the second leg of the current source. Thus, for the purposes of this invention, the current in the current source refers to the current passing through the first leg, i.e. the pilot leg of the current source.

The components are preferably chosen such that the current passing through the second leg and the output leg is approximately equal to the current in the pilot leg. However, this is not essential.

According to another specific aspect of the invention, the output leg junction may be formed by a diode or a bipolar transistor. Note also that the output leg may comprise a single junction or several junctions in series.

BRIEF DESCRIPTION OF THE DRAWINGS

Other characteristics and advantages of the invention will become clearer from the following description with reference to the Figures in the attached drawings. This description is given purely for illustration purposes and is in no way restrictive.

DETAILED DESCRIPTION OF THE PREFERRED EMBODIMENTS

Figure 1:
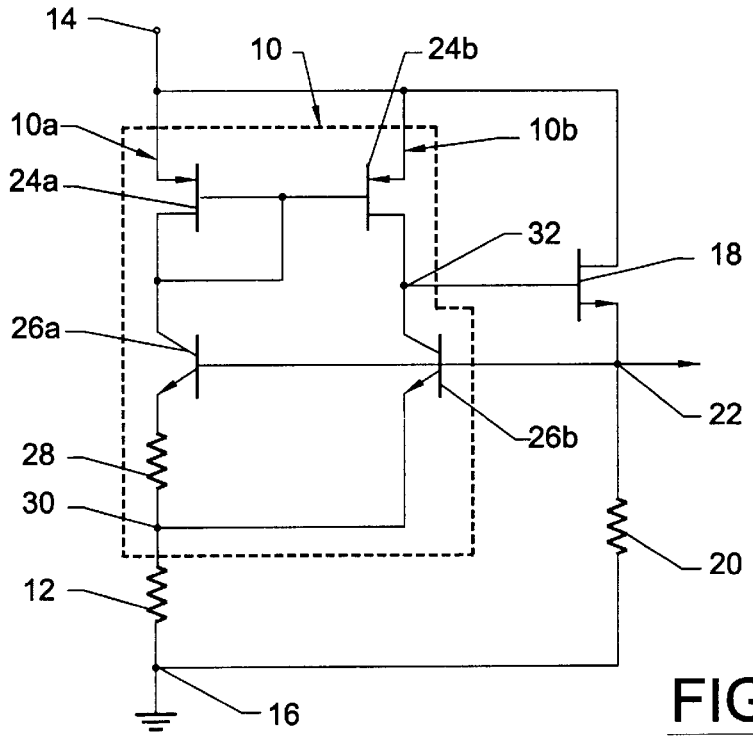
FIG. 1. (PRIOR ART)
FIG. 1 described above, shows an electrical circuit for a prior art constant voltage generating device.
Figure 2:
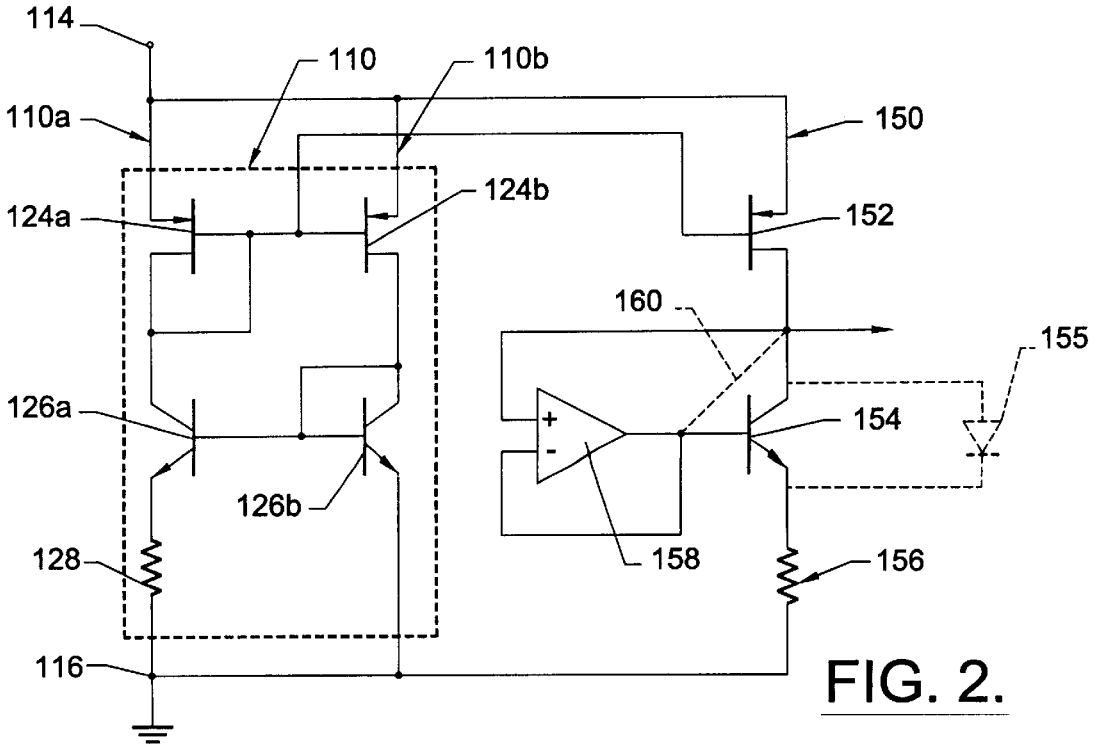
FIG. 2 is an electrical circuit for a constant voltage generating device forming a particular embodiment of the invention.

To facilitate reading FIG. 2, parts in this Figure identical, similar or equivalent to the corresponding parts in FIG. 1 are assigned the same reference numbers plus 100. The device in FIG. 2 comprises a current source 110 with a first leg 110*a* and a second leg 110*b*. The first leg, that forms a pilot leg, carries a current denoted $I_a$. In order and in series starting from a positive power supply terminal 114, it comprises a first transistor 124*a* called the mirror, a second bipolar npn transistor 126*a*, and an emitter resistance 128 that connects the bipolar transistor emitter 126*a* to a power supply ground terminal 116.

In order and in series starting from the power supply terminal 114, the second leg 110*b* comprises a first transistor 124*b*, called the mirror, and a second bipolar npn transistor 126*b* connected by its collector to the first transistor 124*b*. The emitter of the bipolar transistor 126*b* is directly connected to the power supply ground terminal 116. Furthermore, note that the collector of bipolar transistor 126*b* in the second leg is connected to its base and the bases of the bipolar transistors in the first and second legs are directly connected together.

The current $I_a$ in the first leg 110*a* is copied into the second leg 110*b* by a current mirror including the first transistors 124*a* and 124*b*. In this example, it is considered that the current passing through the second leg is approximately equal to the current passing through the first leg.

The device in FIG. 2 also includes an output leg 150. In series and in order starting from the positive power supply terminal 114, the output leg comprises an output transistor 152, an npn bipolar transistor 154 and an adjustment resistance 156. The adjustment resistance 156, with value equal to $R_3$, connects the emitter of the bipolar transistor 154 to the power supply ground terminal 116.

The bipolar transistor 154 is used here as a junction. An operational amplifier 158 is connected in a transistor voltage counter-reaction loop. It is observed that a non-inverting input of the operational amplifier is connected to the collector of the bipolar transistor 154. The output and the inverting input to the operational amplifier are connected together to the base of bipolar transistor 154. This type of connection can bias the transistor and fix its static operating point. However, in a simple embodiment shown as a discontinuous line in the Figure, the counter-reaction loop may be replaced by an electrical connection 160 connecting the base and the collector of the bipolar transistor.

The value $R_3$ of the adjustment resistance is adjusted to make the device practically insensitive to temperature variations. In this example, in which the output leg only includes one junction, the voltage of which is of the order of 0.6 V (silicon), the value $R_3$ is adjusted in order to obtain an output voltage on the order of 1.2 V.

According to one variant, the bipolar transistor may also be replaced by a junction diode 155 biased in the conducting direction between the output transistor 152 and the adjustment resistance 156. This variant is shown as a discontinuous line in FIG. 2.

The gate of the output transistor 152 is electrically connected to the gates of the first transistors 124*a*, 124*b* in the current source. Thus, the first transistor 124*a* in the first leg 110*a* and the output transistor 152 in the output leg form a current mirror to copy the current passing through the first leg 110*a* into the output leg.

Although it is not essential, it is assumed in the rest of the description that the current values in the pilot leg and in the output leg are approximately equal.

Operation of the current source 110 in the device in FIG. 2 is approximately identical to operation of the current source 10 in FIG. 1. Thus a detailed explanation of this operation is not given here. However, note in FIG. 2 that there is no resistance corresponding to the adjustment resistance 12 in FIG. 1. The resistance of the emitter 128 in the first leg and the emitter of the bipolar transistor 126*b* in the second leg are directly connected to the power supply ground terminal 116. One consequence of this type of connection is that the collector-emitter voltages of the bipolar transistors 126*a* and 126*b*, denoted $V_{CEa}$ and $V_{CEb}$, are increased above those in FIG. 1, for the same value of the power supply voltage.

The increase in the collector-emitter voltage of the transistors also increases their sensitivity to the Early effect. Furthermore, in the device in FIG. 2, the compensation of the spread of characteristics by the Early effect is applicable not only to the bipolar transistor in the first (pilot) leg 110*a* of the current source, but also to the bipolar transistor 154 of the output leg 150.

Taking into account the Early effect, the current passing through the bipolar transistor 126*a* in the pilot leg 110*a* must be multiplied by a correction factor $X_a$ as follows:

$$X_a = \frac{\left(1 + \frac{V_{CEa}}{V_{AFtyp}}\right)}{\left(1 + \frac{V_{CEa}}{V_{AFmax}}\right)},$$

where $V_{CEa}=V_{CC}-V_{GSa}$ and $V_{GSa}$ is the source grid voltage of the first transistor 124*a* in the pilot leg (the grid is directly connected to the drain), the result is $V_{CEa}=5-1.5=3.5$ for a power supply voltage $V_{CC}$ of 5 V and thus, for the same values of $V_{AFtyp}$ and $V_{AFmax}$ used for the calculations in FIG. 1, we obtain $X_a=0.9885$.

As explained previously, the current in the pilot leg is copied into the output leg. In this leg, a second dispersion correction factor $X_s$ has to be considered taking account of the Early effect in the bipolar transistor 154 in the output leg.

The correction factor $X_s$ is as follows:

$$X_s = \frac{\left(1 + \frac{V_{CEs}}{V_{AFtyp}}\right)}{\left(1 + \frac{V_{CEs}}{V_{AFmax}}\right)},$$

In this expression, $V_{CEs}$ is the collector-emitter voltage of the bipolar transistor in the output leg. Since the collector potential and the base potential in this transistor are practically the same, we have $V_{CEs}=V_{BEs}\approx 0.7$ V (where $V_{BEs}$ is the voltage at the terminals of the base-emitter junction of the bipolar transistor). Using the same values of $V_{AFtyp}$ and $V_{AFmax}$, we obtain $X_s=0.9976$.

The output voltage $V_{GAP}$ measured on the collector of the bipolar transistor 154 of the output leg is subject to variations $\Delta V_{GAP}$ as a function of the dispersion of the characteristics, such that:

$$\Delta V_{GAP}=\Delta V_{BEs}+\Delta V_{R3}=\Delta V_{BEs}+V_{R3}(1-X_a\cdot X_s)=-7\text{ mV}+7.3\text{ mV}\approx 0.3\text{ mV}.$$

In this expression, $V_{R3}$ denotes the typical voltage at the terminals of the adjustment resistance 156 (530 mV) and $\Delta V_{R3}$ denotes the voltage variation of the terminals at the adjustment resistance 156. It is found that the variation $\Delta V_{GAP}$ (0.3 mV) in the case of the device in FIG. 2 according to the invention, is very much less than $\Delta V_{GAP}$ (4 mV) in the case of the device shown in FIG. 1. Thus the output voltage $V_{GAP}$ in the device according to the invention is practically insensitive to the dispersion or spread of the characteristics of the transistors used.

Figure 3:
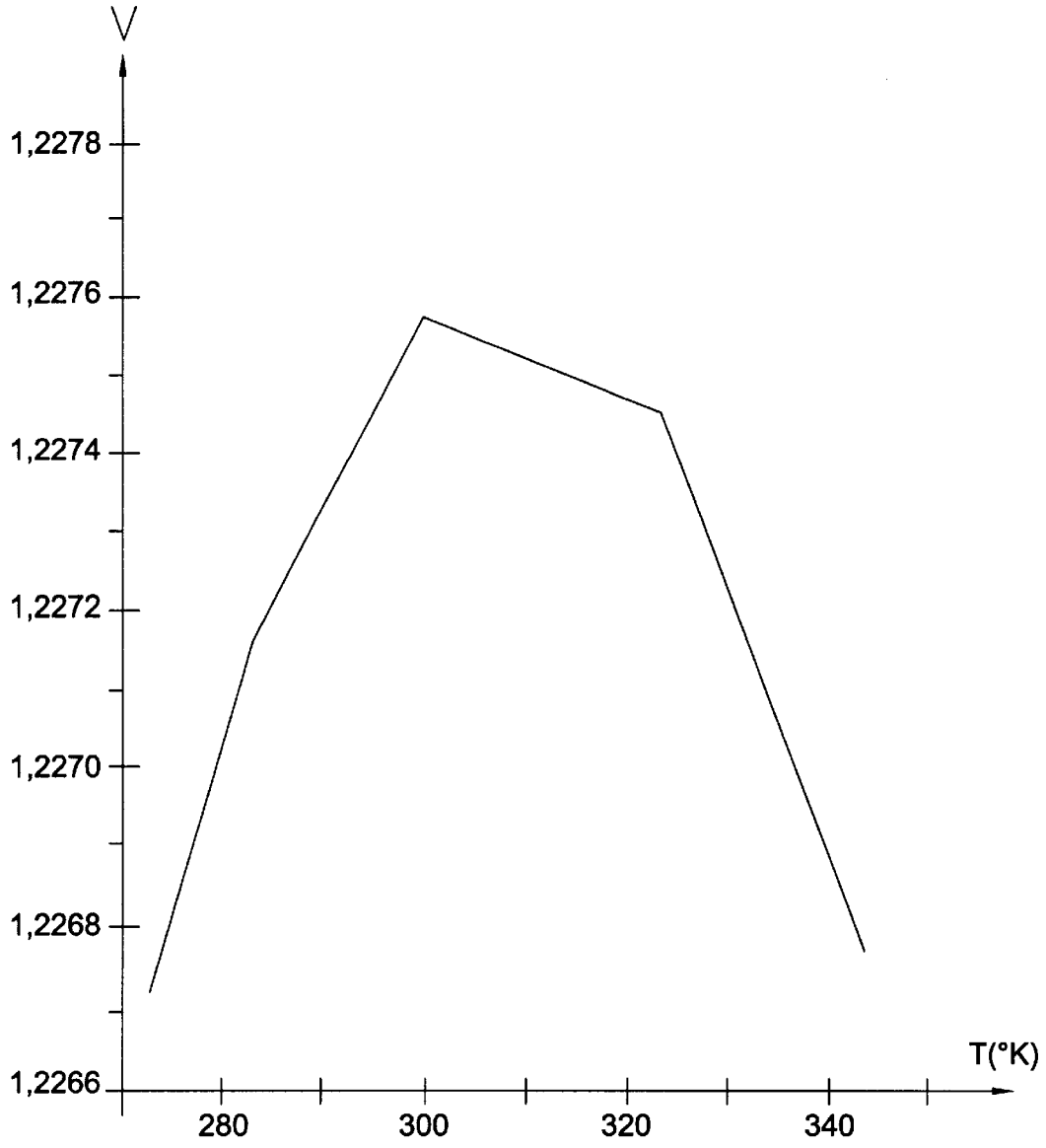
FIG. 3 is a graph illustrating the variation of the output voltage of the device in FIG. 2 as a function of the temperature.

FIG. 3 illustrates operation of the device by expressing the value of the output voltage $V_{GAP}$ of the device in FIG. 2 as a function of the temperature in graphic form. The voltage $V_{GAP}$ is shown on the ordinate and is expressed in Volts, whereas the temperature shown on the abscissa is expressed in degrees Kelvin. The graph shows that the output voltage varies by less than 1 mV within a temperature variation range of 70° C. Thus, the sensitivity of the device to the dispersion of component characteristics is approximately on the same order, or is less than, the sensitivity to temperature.

What is claimed is:

1. A band-gap constant voltage generating device comprising:

a current source comprising first and second legs to generate a current that increases linearly as a function of temperature; and an output leg comprising a bipolar transistor and a load resistance connected in series with said bipolar transistor between power supply terminals, and an operational amplifier connected between collector and base terminals of said bipolar transistor;

the second leg and said output leg comprising respective mirror portions defining a first current mirror to copy current from said current source into said output leg so that a voltage at said bipolar transistor reduces linearly with temperature.

2. A device according to claim 1 wherein the first leg of said current source comprises a first mirror transistor, a second bipolar transistor and an electrical resistance connected in order and in series between power supply terminals.

3. A device according to claim 2 wherein the second leg of said current source comprises a first mirror transistor and a second bipolar transistor connected in order and in series between power supply terminals.

4. A device according to claim 3 wherein the first mirror transistors in the first and second legs define a second current mirror.

5. A device according to claim 3 wherein the second bipolar transistor in the first leg has an emitter surface area larger than an emitter surface area of the second bipolar transistor in the second leg.

6. A device according to claim 1 wherein the mirror portion of said output leg comprises an output transistor connected in series with said bipolar transistor and the load resistance.

7. A band-gap constant voltage generating device comprising:

a current source to generate a current that increases as a function of temperature; and an output leg comprising a bipolar transistor and a load resistance connected in series with said bipolar transistor between power supply terminals, and an operational amplifier connected between collector and base terminals of said bipolar transistor;

said current source and said output leg comprising respective mirror portions defining a first current mirror to copy current from said current source into said output leg so that a voltage at said bipolar transistor reduces with temperature to thereby provide a substantially constant output voltage despite temperature variations.

8. A device according to claim 7 wherein said current source comprises first and second legs; and wherein the first leg of said current source comprises a first mirror transistor, a second bipolar transistor and an electrical resistance connected in order a nd in series between power supply terminals.

9. A device according to claim 8 wherein the second leg of said current source comprises a first mirror transistor and a second bipolar transistor connected in order and in series between power supply terminals.

10. A device according to claim 9 wherein the first mirror transistors in the first and second legs define a second current mirror.

11. A device according to claim 9 wherein the second bipolar transistor in the first leg has an emitter surface area larger than an emitter surface area of the second bipolar transistor in the second leg.

12. A device according to claim 7 wherein the mirror portion of said output leg comprises an output transistor connected in series with said bipolar transistor and the load resistance.

13. A device according to claim 7 wherein said current source generates a current that increases linearly as a function of temperature; and wherein the first current mirror copies current from the current source into the output leg so that a voltage at said bipolar transistor reduces linearly with temperature.

14. A method for generating a substantially constant voltage comprising the steps of:

using a current source to generate a current that increases as a function of temperature; and providing an output leg comprising a bipolar transistor and a load resistance connected in series with said bipolar transistor between power supply terminals, and an operational amplifier connected between collector and base terminals of said bipolar transistor;

using a first current mirror comprising respective mirror portions of the current source and the output leg to copy current from the current source into the output leg so that a voltage at said bipolar transistor reduces with temperature to thereby provide a substantially constant voltage despite temperature variations.

15. A method according to claim 14 wherein the current source comprises first and second legs; and wherein the first leg of the current source comprises a first mirror transistor, a second bipolar transistor and an electrical resistance connected in order and in series between power supply terminals.

16. A method according to claim 15 wherein the second leg of the current source comprises a first mirror transistor and a second bipolar transistor connected in order and in series between power supply terminals; wherein the first mirror transistors in the first and second legs define a second current mirror; wherein the second bipolar transistor in the first leg has an emitter surface area larger than an emitter surface area of the second bipolar transistor in the second leg; and wherein the mirror portion of the output leg comprises an output transistor connected in series with said bipolar transistor and the load resistance.

* * * * *